United States Patent [19]

Möller et al.

[11] Patent Number: 5,057,842

[45] Date of Patent: Oct. 15, 1991

[54] OUTER WALL OF A STRUCTURE LOCATED NEAR A RADAR STATION

[75] Inventors: Erhard Möller, Aachen; Lutz Bernstein, Übach-Palenberg, both of Fed. Rep. of Germany

[73] Assignee: Vegla Vereinigte Glaswerke GmbH, Aachen, Fed. Rep. of Germany

[21] Appl. No.: 512,781

[22] Filed: Apr. 20, 1990

[30] Foreign Application Priority Data

Apr. 24, 1989 [DE] Fed. Rep. of Germany ..... 3913421

[51] Int. Cl.[5] ..... H01Q 17/00

[52] U.S. Cl. ..... 342/4; 342/1

[58] Field of Search ..... 342/1, 3, 4, 5

[56] References Cited

U.S. PATENT DOCUMENTS 2,527,918 10/1950 Collard .
3,315,261 4/1967 Wesch ..... 342/4
4,118,704 10/1978 Ishino et al. ..... 342/4
4,327,364 4/1982 Moore .
4,910,074 3/1990 Fukawa et al. ..... 428/215

*Primary Examiner*—Gilberto Barron, Jr.
*Attorney, Agent, or Firm*—Marmorek, Guttman & Rubenstein

[57] ABSTRACT

In order to decrease the interfering reflection of radar radiation from building walls during radar surveillance on the ground, the outer walls are formed on their surfaces so that the reflected radar waves are subjected in part to a phase shift of one half wavelength with respect to each other. This results in a partial obliteration of the reflected waves. The reflecting surface of the outer wall comprises for that purpose of individual elements whose superficial extent is smaller than the surface irradiated by a radar impulse, and which are staggered in depth in such manner that adjoining surface elements are located at a distance from each other which is equal, for perpendicular incidence of the radar radiation, to one quarter wavelength of the radar radiation used.

7 Claims, 3 Drawing Sheets

OUTER WALL OF A STRUCTURE LOCATED NEAR A RADAR STATION

FIELD OF THE INVENTION

The instant invention relates to the outer wall of a structure located near a stationary radar station.

BACKGROUND OF THE INVENTION

When radar technology is used to detect and locate airplanes and ships in proximity of the ground, structures such as building walls or soundproofing walls with outer skins that are highly reflective of radar rays often interfere with these measurements. When planes on the ground or at low altitude are to be monitored by radar, large buildings such as hangars which can be up to several tens of meters long and up to several times ten meters high can have an extremely disturbing effect. This is due to the fact that the outer walls of these structures produce radar reflections which make it difficult for the radar to get precise bearings on planes.

Different technical solutions to eliminate interfering radar reflections are known. According to a first known solution, reflecting screens are installed in front of the structures to deflect the incident radar rays in a less disturbing direction. According to another known principle for which practical embodiments are described in U.S. Pat. No. 4,327,364, the building surfaces concerned which cause interfering reflections are overlaid with specially constructed absorption systems into which the radar rays are absorbed and converted into heat radiation.

It is an object of the instant invention to form the outer wall of a structure in such manner that interfering radar reflections are avoided without having to use additional reflecting screens or special absorption systems.

SUMMARY OF THE INVENTION

This object is attained through the invention in that the outer wall of a structure comprises individual construction elements. Each of the individual construction elements is provided with a flat outer surface with a high reflectivity for radar radiation. The surface dimensions of the individual construction elements are greater than the wavelength of the radar radiation but smaller than the surface impacted by a radar impulse. In addition, the individual construction elements are alternately staggered in depth, i.e. the surface areas in which adjoining construction elements are installed are at a distance from each other. This leads to a phase difference causing the rays reflected from the staggered construction elements to be cancelled out for a given angle of incidence.

The staggering in depth of the individual construction elements corresponds to one quarter wavelength for perpendicular incidence of the radar radiation. When the incidence is oblique, i.e. when the building wall is oriented at an angle to the radar transmitter which is other than 90 degrees, the extent of depth-staggering must be selected on basis of a cosine function of the angle of incidence of the radar radiation.

The configuration of the surface of the outer wall according to the present invention makes it possible for each radar impulse reaching such a surface to be reflected by several construction elements installed at different depths. The radar waves reflected by the different construction elements have phase differences of one half wavelength from each other as a result of the depth-staggering of the construction elements so that the reflected waves cancel each other out. In this manner the radar rays reflected from the building wall are extensively cancelled out by destructive interference so that the feared disturbance of radar measurements no longer occurs.

The wavelength of radar rays of airport surveillance radars (ASR's and SRE installations) is today uniformly 30 centimeters all over the world. The surface dimensions of the individual reflecting construction elements should therefore be selected so that the curvature phenomena occurring in the border zones of the individual construction elements can be ignored. This is the case when the surface dimensions of the reflecting construction elements measure approximately three times to five times the wavelength used. This means that the edge length in both dimensions should measure 90 to 150 centimeters or more in rectangular construction elements.

The surface irradiated by a radar ray depends on the one hand on the opening angle of the radiation and on the other hand on the distance from the radar transmitter. At the usual opening angle of approximately 4 degrees of the radar radiation the irradiated surface has already a superficial extent of approximately 70 meters at a distance of 1000 meters from the radar transmitter. Under normal circumstances the individual construction elements are therefore sufficiently small by comparison to the surface irradiated by the radar radiation in order to achieve the desired cancellation effect of the reflected radar radiation.

The design of the outer wall of a building according to the instant invention can be realized by different means and with different materials. Construction elements with two different thicknesses can be produced for instance, whereby their surfaces directed towards the inside of the building constitute a plane, while the outer surfaces are provided with the depth-staggering according to the invention. Such an outer wall does therefore not have a uniform wall thickness but its thickness varies from one surface segment to the other.

Another possibility for the design of a building wall according to the invention comprises mounting plates with plane-parallel surfaces and with the same thickness in an array or grid construction with alternating depth positions. Such a design could be implemented especially easily by an array-like metal frame design having profiled support bars with cross-sections determined by the depth-staggering, and where the plates constituting the individual segments could be built into the frame structure alternately flush with the outer surface of the frame structure and with the inner surface of the frame structure which is oriented to the inside of the building.

A building wall constituted in accordance with the instant invention can also be designed so that the outer surface of the wall is covered by an overall outer skin, despite the depth-staggering of the reflecting construction elements. This can be achieved, for example, by filling the outside of those sections in which the deeper construction elements are installed with plates on the outside which are transparent to radar radiation, e.g. with plates made of a suitable synthetic material. These plates are advantageously installed in the plane of the outer reflecting construction elements. The radar rays penetrate in that case the plates of synthetic material without hindrance and are reflected from the surface of the construction elements behind them. In this manner facades with a flat plane surface can be obtained.

The individual construction elements can be given in principle any desired configuration. In its simplest form they are square or rectangular in shape. However, they can also be in form of triangles or hexagons linked together. It is practical for all the surface segments of a building wall to have the same shape and the same dimensions, but it is of course also possible to combine construction elements of different forms and sizes with each other, as long as a statistically uniform distribution of the depth-staggered construction elements is present within the surface irradiated by the radar rays.

The wall elements or plates used to construct the building wall can be made of sheet metal, for example. Sheet metal with a plane surface has a reflection factor of R=1 with perpendicular incidence of the radar radiation, which means that 100% of the incident radar radiation is reflected from the surface of the sheet metal. Through the design according to the invention of a wall made of sheet metal, such thorough cancellation of the reflecting radiation is achieved that a reduction of the reflected radiation by up to 90% of the incident radiation can be achieved in practice.

Equally good results can be obtained when silicate glass panes instead of sheet metal are used for the construction of the outer wall. Glass panes have a reflection factor R of approximately 0.35 to 0.5 for radar rays with perpendicular irradiation, and this factor can increase with an increasing angle of incidence up to R=1, so that when glass panes are used for the construction according to the invention of the building walls, the reflected portion of the radar radiation is also cancelled out by interference. The portion of radar radiation penetrating the glass panes can be absorbed and attenuated inside the building, so that this portion can also be neutralized. When light-transparent glass panes are used as construction elements for the building wall, not only the illumination of the building with natural light is rendered possible, but the known good qualities of glass such as weather resistance, durability, etc. can also be benefited from at the same time.

In an especially advantageous embodiment of the invention, silicate glass panes coated with a thin, light-transparent metal coating, e.g. a silver layer of 5 to 20 nm thickness are used for the construction elements. Such coated glass panes in which the silver layer is normally imbedded between adhesive and protective layers made of a metal oxide are known and are normally used as infrared-reflecting, i.e. heat radiation reflecting glass panes.

Such metal-coated glass panes possess a heightened reflection factor, corresponding to the reflection factor of a metal plate.

The invention can be used to special advantage with glazing and with hangar doors and other structures on the property of an airport. The application of the invention is however not limited to airports and their surroundings. Since the same problems also occur sometimes with other types of radar stations, e.g. for the surveillance of shipping lanes, the invention can be used successfully in such cases too. In that case it is only necessary to ensure that the individual construction elements and the distances of the planes in which the construction elements are installed be matched to the wavelength of the applicable radar transmitter.

DETAILED DESCRIPTION OF THE INVENTION

Figure 1:
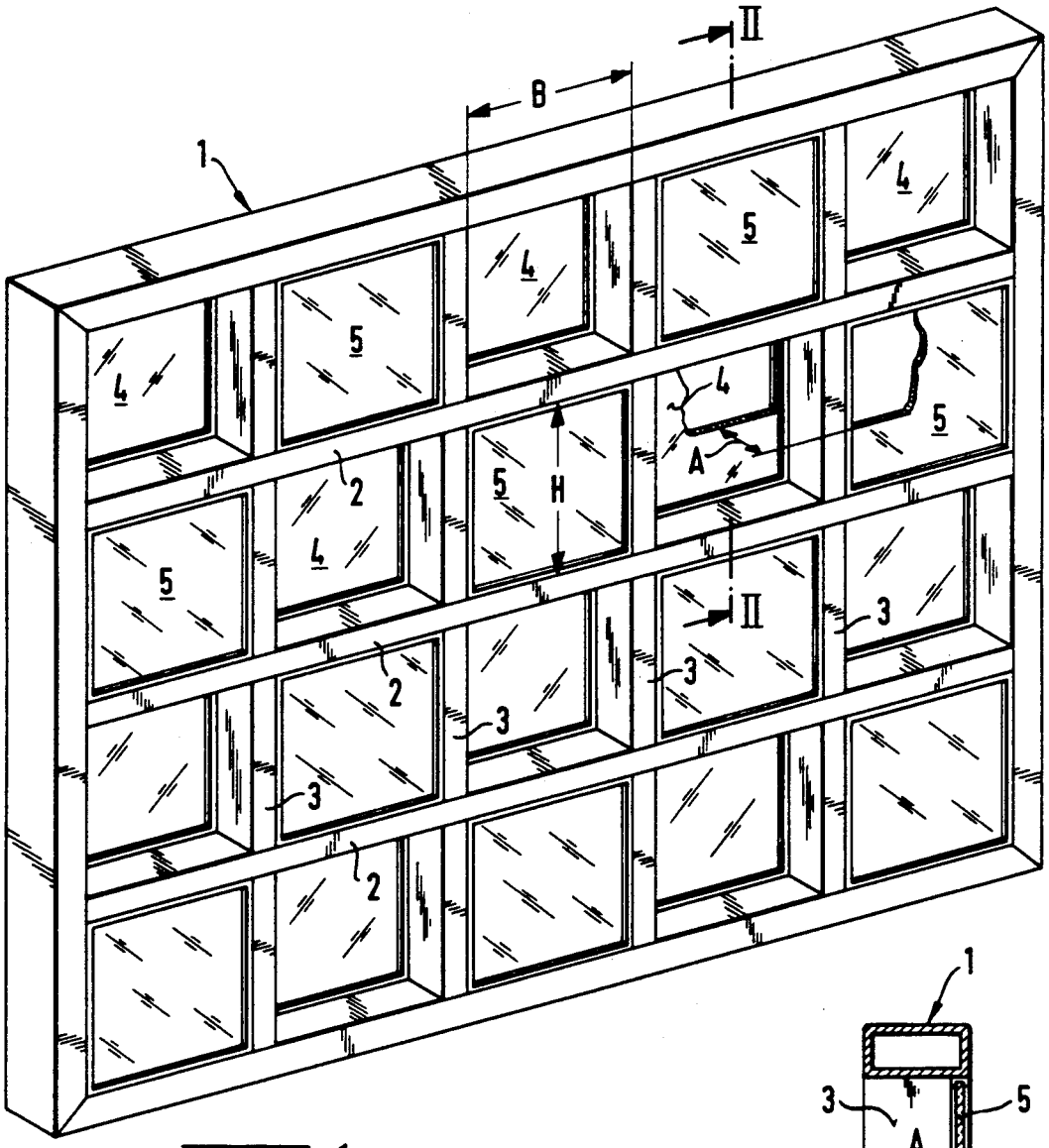
FIG. 1 shows an embodiment of a wall element built in accordance with the present invention in an overall perspective view.
Figure 2:
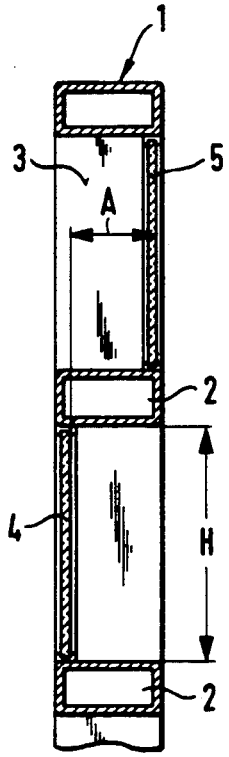
FIG. 2 shows a section through FIG. 1 along line II—II.

The invention is explained in FIGS. 1 and 2 showing a wall element. This wall element can be a fixedly incorporated or a movable part of a building, for example the window or the door of a building or of a hangar. However the invention is of course not limited to such wall elements. The invention can be realized in particular by developing the entire facade design of a building in accordance with the invention, whereby the facade design forms individual surface portions in which are inserted plates (i.e. construction elements). The attachment of the individual plates constituting the individual construction elements can be designed in different manners.

The wall element shown in FIG. 1 comprises an outer frame 1, made for instance of profiled bars with a rectangular profile, and a series of longitudinal and cross struts 2,3 arranged within the frame 1 and forming an array within the frame 1.

If a radiation with a wavelength of 30 cm for example is used for the radar of an airport, the array is designed so that the width B and the height H of each array element comes to approximately 1 meter. Under these conditions the radar rays are only minimally reflected at the array structure (1,2,3) itself, meaning that the array structure as such is maximally penetrated by the radar rays. Each array element is closed by an inserted glass pane 4 or 5. In order to increase the reflective properties of the glass panes 4 and 5, these are glass panes which are provided with a partially reflecting metallic surface coating, e.g. a thin, light-transparent silver layer which is provided between adhesive and protective layers made of metal oxides and they are alternately installed in the rear limit plane of the array structure and in the forward limit plane of the array structure and are attached there in the usual manner. The distance A constituted by the distance between forward reflecting surfaces of the glass panes 4 and 5 is equal, with perpendicular incidence, to one quarter wavelength of the radar radiation used; with a wavelength of 30 cm, it is therefore 7.5 cm.

When the radar radiations reach the building facade at an angle of less than 90 degrees, the distance A decreases in accordance with the cosine of the angle of incidence. It may then be advantageous to select a facade construction in which the distance A between the two reflection planes is adjustable, for instance by providing mountings for the glass panes 4 and 5 which are adjustable within the facade construction at a right angle to the plane of the glass panes and which can be fixed at the desired setting. Such a facade construction is basically usable for any orientation of the facade in relation to the radar transmitter, and it suffices to merely find the distance A for each individual case.

The invention can also be used successfully in cases where the radar radiation transmitted by two different radar transmitters falls upon the building facade, as is often the case especially with large airports. In that case the radar rays originating at the two radar reach the building facade at different angles of incidence. The conditions for the obliteration of the reflected rays by interference are therefore different for the rays emitted by one radar transmitter than for the rays emitted by the other transmitter. In this case too, extensive obliteration of the reflected radiation of the two radar transmitters can be achieved by means of the principle according to the instant invention if construction elements are provided for one radar transmitter as well as for the other radar transmitter which are staggered at different distances, with both systems nesting into each other.

Figure 3:
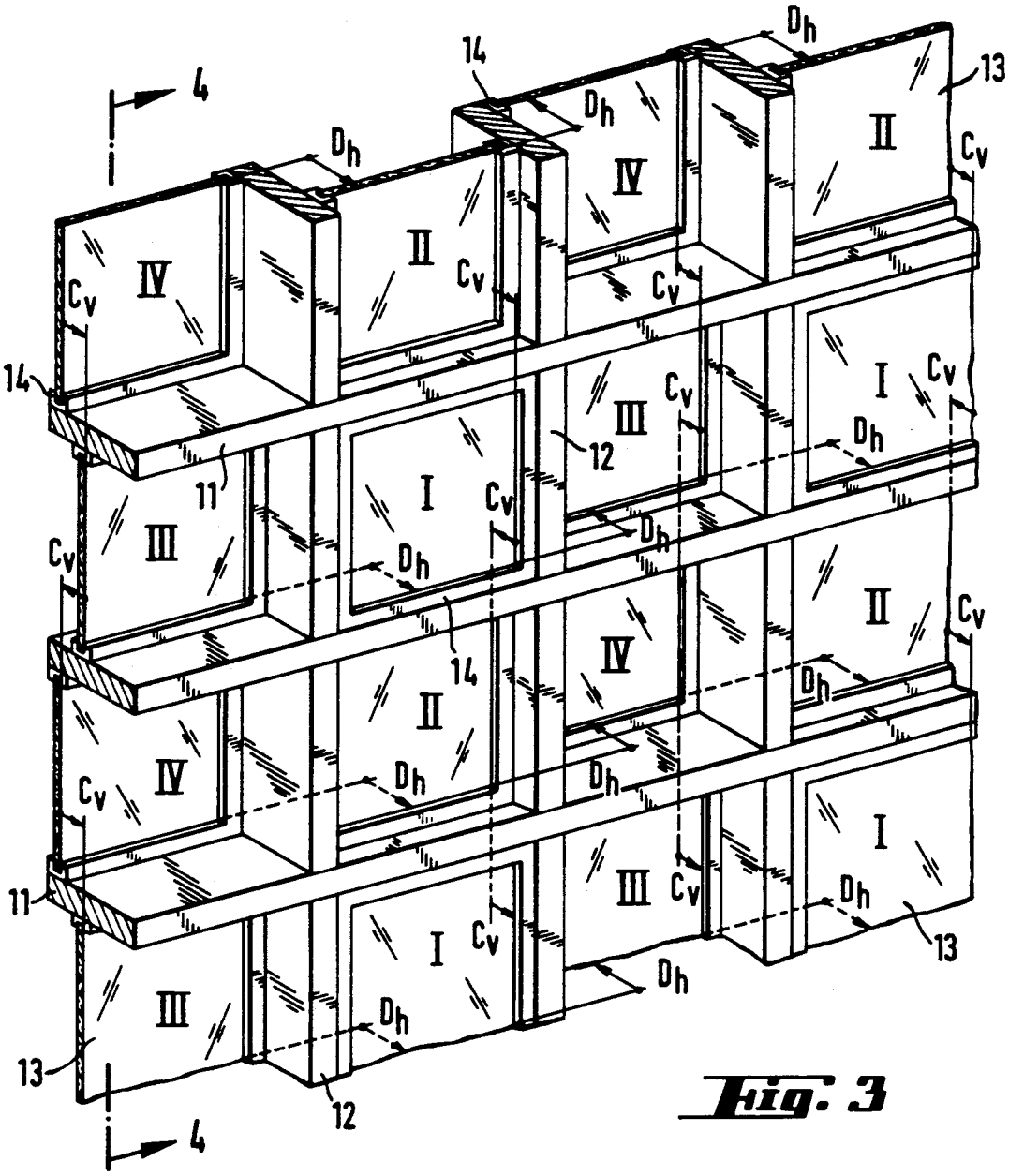
FIG. 3 shows another embodiment for the construction of a wall according to the present invention in a perspective view.
Figure 4:
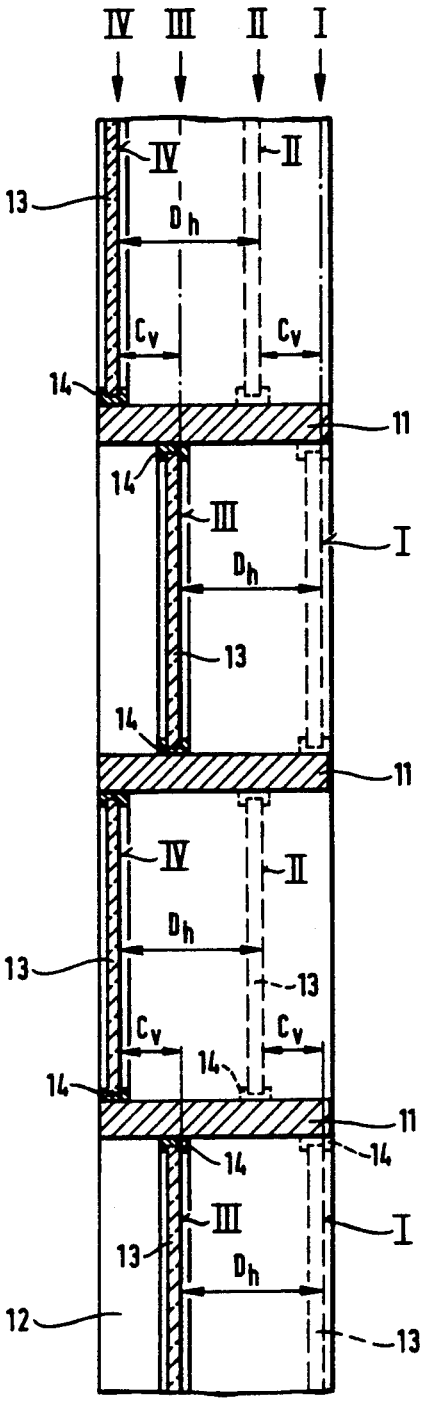
FIG. 4 shows a section through the wall shown in FIG. 3 along the line IV—IV.

An example of a facade construction designed in this manner is shown in FIGS. 3 and 4. The facade construction comprises an array made up of horizontally extending profiled bars 11 and vertically extending profile rods 12 which define the individual elements of the facade. In each of these elements, a glass pane 13 provided with an appropriate light-transmitting metal coating is in turn installed. In the present case the glass panes 13 are arranged in four different planes which are designated as plane I, plane II, plane III and plane IV.

The glass panes 13 are attached within the array structure by means of frames 14. The frames 14 and the profiled bars 11 and 12 are provided with appropriate attachment means which make it possible to fix the frames 14 in the desired position for each in planes I, II, III and IV.

As can be seen in FIGS. 3 and 4, the glass panes 13 of every two adjoining elements in each horizontal row are installed at a distance $D_h$ from each other. This means that the distance between planes I and III and between planes II and IV is $D_h$. In each vertical row, the glass pane of each element is offset by a distance $C_v$ from an adjoining element, meaning that the distance between planes III and IV as well as between I and II is $C_v$. Thus, while those glass panes 13 which are offset by a distance $D_h$ to each other cause extensive obliteration of the radar rays coming from a first, fixed radar transmitter and reflected by these glass panes, those glass panes 13 which are offset by a distance $C_v$ to each other cause the extensive obliteration of the radar rays emitted by a second fixed radar transmitter and reflected by these glass panes.

Finally, the above-described embodiment of the invention are intended to be illustrative only. Numerous alternative embodiments may be described by those skilled in the art without departing from the spirit and scope of the following claims.

We claim:

1. A wall structure for use in proximity to a stationary radar installation which emits impulses of radar radiation of a particular wavelength comprising a plurality of individual construction elements, each of said construction elements having a planar surface with a high reflection capability for the radar radiation of said particular wavelength for reflecting said impulses of radar radiation, each of said construction elements having surface dimensions greater than the particular wavelength of the radar radiation but an area smaller than the surface area irradiated by said impulses of radar radiation, said individual construction elements being positioned alternately in a staggered manner in first and second planes separated by a distance determined by the angle of incidence of the radar radiation at the particular wavelength so that the phase difference between the radar radiation reflected from the construction elements in the two planes results substantially in the destruction of the reflected radar radiation at said particular wavelength via destructive interference.

2. The wall as in claim 1, wherein the construction elements are staggered in more than two planes for destroying via interference the reflected radar radiation of at least two different radar installations emitting radar radiation at respective particular wavelengths.

3. A wall structure for use in proximity to a stationary radar installation which emits impulses of radar radiation comprising a plurality of individual construction elements, each of said construction elements having a planar surface with a high reflection capability for the radar radiation, each of said construction elements having surface dimensions greater than the wavelength of the radar radiation but an area smaller than the surface area irradiated by said impulses of radar radiation, said individual construction elements being positioned alternately in a staggered manner in first and second planes separated by a distance determined by the angle of incidence of the radar radiation so that the phase difference between the radar radiation reflected from the construction elements in the two planes results substantially in the destruction of the reflected radar radiation via interference, wherein the individual construction elements are mounted in an array structure comprising horizontal profile bars and vertical profile bars.

4. The wall as in claim 3, wherein the individual construction elements have an extent in both surface dimensions that is at least 3 to 5 times the wavelength of the radar radiation.

5. The wall of claim 3 wherein the individual construction elements are silicate glass panes.

6. The wall of claim 5 wherein each silicate glass pane is provided with a light-transparent metal coating which increases the reflection factor.

7. The wall of claim 3 wherein the construction elements are held in frames which can be fixed within the array structure in any desired position.

* * * * *